United States Patent [19]

Simpson

[11] 4,431,076

[45] Feb. 14, 1984

[54] ADJUSTABLE COLLAPSIBLE WHEELCHAIR

[76] Inventor: Robert C. Simpson, 1231 Azalea Dr., Tallahassee, Fla. 32301

[21] Appl. No.: 276,775

[22] Filed: Jun. 24, 1981

[51] Int. Cl.[3] ..... A61G 5/00

[52] U.S. Cl. ..... 180/65 R; 180/DIG. 3; 280/242 WC; 280/650; 296/65 R; 297/DIG. 4

[58] Field of Search ..... 180/DIG. 3, 65 R; 280/242 WC, 289 WC, 650, 647, 42, 643, 87.02 R; 296/65 R; 297/DIG. 4, 45, 42, 115, 416, 345, 338

[56] References Cited

U.S. PATENT DOCUMENTS

| | | | |
|---|---|---|---|
| 1,307,058 | 6/1919 | McGrath | 297/DIG. 4 |
| 2,374,182 | 4/1945 | Duke | 297/DIG. 4 |
| 2,459,066 | 1/1949 | Duke | 297/DIG. 4 |
| 2,530,544 | 11/1950 | Schwantes | 297/DIG. 4 |
| 2,546,765 | 3/1951 | McKinley | 297/DIG. 4 |
| 2,609,862 | 9/1952 | Pratt | 297/338 |
| 2,641,306 | 6/1953 | Lerman | 297/DIG. 4 |
| 2,792,052 | 5/1957 | Johannsesen | 297/DIG. 4 |
| 2,866,495 | 12/1958 | Diehl et al. | 297/DIG. 4 |
| 2,915,112 | 12/1959 | Schwartz | 297/DIG. 4 |
| 3,142,351 | 7/1964 | Green | 180/DIG. 3 |
| 3,244,453 | 4/1966 | Fox | 297/DIG. 4 |
| 3,443,784 | 5/1969 | Walkinshaw | 297/345 |
| 3,905,436 | 9/1975 | Karchak, Jr. et al. | 180/DIG. 3 |
| 3,937,519 | 2/1976 | Schoolden | 297/347 |
| 3,953,054 | 4/1976 | Udden et al. | 280/242 WC |
| 4,165,127 | 8/1979 | Vago | 297/345 |
| 4,323,133 | 4/1982 | Williams | 180/DIG. 3 |
| 4,351,540 | 9/1982 | Minnebraker | 297/338 |

FOREIGN PATENT DOCUMENTS

| | | | |
|---|---|---|---|
| 4205 | 9/1979 | European Pat. Off. | 280/242 WC |
| 2731952 | 1/1978 | Fed. Rep. of Germany | 280/242 WC |
| 2048661 | 12/1980 | United Kingdom | 297/DIG. 4 |

*Primary Examiner*—David M. Mitchell
*Attorney, Agent, or Firm*—Dowell & Dowell

[57] ABSTRACT

A wheelchair in which the armrests and the seat are vertically adjustable by the occupant so that the occupant may selectively move himself to a "sitting" or "standing" position. The seat has seat belts by means of which the occupant connects himself to the seat and such seat is carried by a vertically adjustable rod which may be locked in adjusted position. The armrests are selectively mounted on upper or lower portions of the side frames of the wheelchair.

11 Claims, 13 Drawing Figures

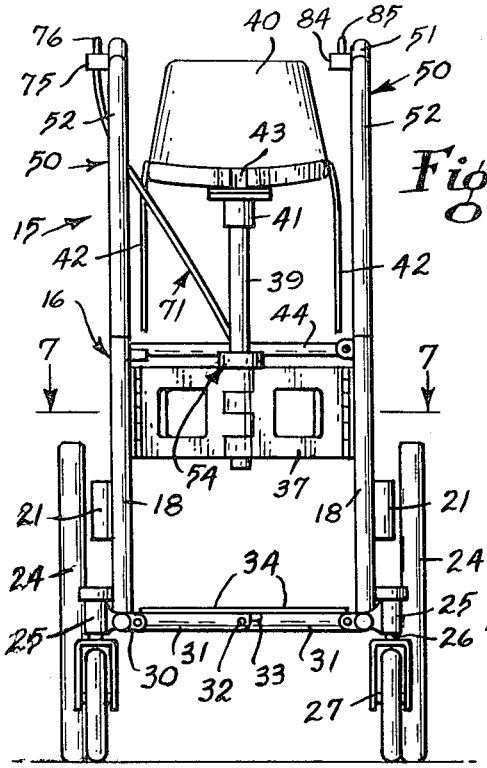
Fig. 1
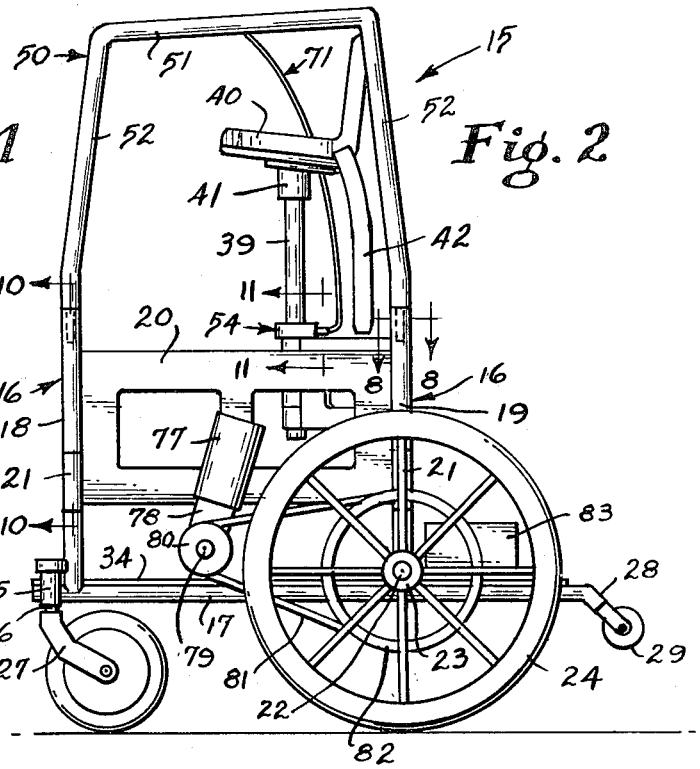
Fig. 2
Fig. 3
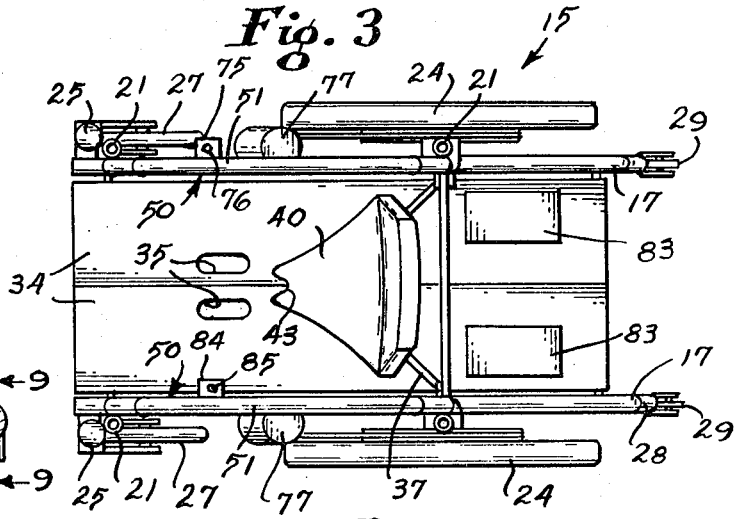
Fig. 7
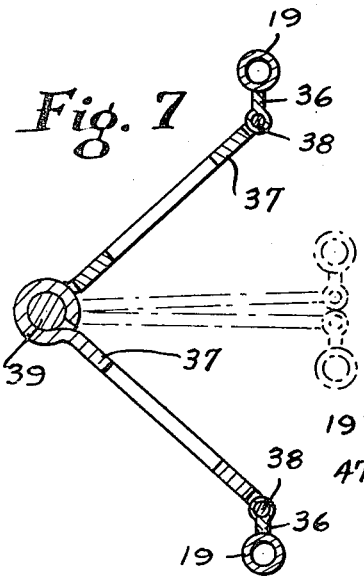
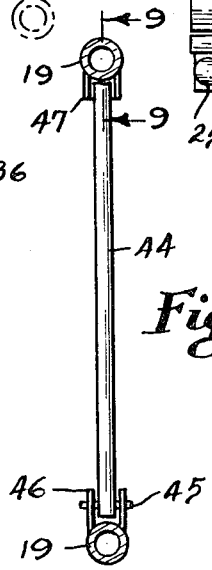
Fig. 8
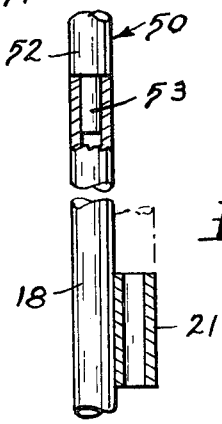
Fig. 10
Fig. 9
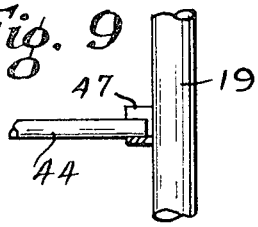

ADJUSTABLE COLLAPSIBLE WHEELCHAIR

TECHNICAL FIELD

This invention relates generally to wheeled vehicles and relates particularly to wheelchairs which may be manually driven or power driven and which are selectively adjustable by the occupant.

BACKGROUND ART

In the past, many wheelchairs and other invalid assistance vehicles have been provided to assist in transporting non-ambulatory persons. In some of these vehicles, particularly invalid walkers, adjustable seats and side rails have been provided so that the walker may be adjusted to the particular size of the invalid. However, such adjustments normally are at least semi-permanent and remain in the adjusted position as long as the individual patient has need for the vehicle. Some examples of this type of structure are disclosed in U.S. Pat. Nos. 1,307,058 McGrath; 2,374,182 Duke; 2,459,066 Duke; 2,530,544 Schwantes; 2,792,052 Johannesen; and 2,866,495 Diehl et al.

Other prior art vehicles, particularly certain wheelchairs, are provided with a fixed frame supported by wheels and having a jack or the like for raising the seat of the vehicle so that the occupant of the vehicle may be positioned at a desired elevation. Some examples of this type of structure are disclosed in U.S. Pat. Nos. 2,546,765 McKinley; 2,609,862 Pratt; 2,915,112 Schwarz; 3,905,436 Karchak et al; 3,937,519 Schoolden; and 3,953,054 Udden et al.

In other prior art vehicles, such as that shown in U.S. Pat. No. 2,641,306 to Lerman, a wheelchair having a seat and back is provided which may be raised and lowered selectively by a jack and which may be collapsed when desired including when the wheelchair is occupied. In order to do this, the seat and back must be flexible since they are connected to the side frames. Also, even though the seat and back may be raised, the armrests remain fixed because they are integrally formed with the side frames. Accordingly, the occupant loses the sense of security offered by the armrests when the seat is elevated.

DISCLOSURE OF THE INVENTION

When a fully functioning adult suffers an accident or illness which either temporarily or permanently disables one or both legs, he is frequently confined to a wheelchair as a mode of transportation. This confinement not only causes a trauma in that the person is confined to a sitting position, but is also faced with a severe psychological impact of a loss of eye level contact with other persons. Also, persons confined to wheelchairs normally cannot avail themselves of displays and saleable items in markets and stores which are intended for persons of normal height and in addition, the person in a wheelchair is frustrated due to his inability to use conventional kitchen equipment effectively, particularly with regard to counters and work surfaces which are designed for use by people standing erect. From a medical standpoint, persons confined to a wheelchair normally do not get enough exercise to maintain muscle tone and prevent muscle and bone deterioration.

The present invention is embodied in an adjustable collapsible wheelchair including a pair of side frames which are connected together by a pair of articulated base plates as well as a pair of hinged seat support members. A telescoping rod, which pivotally supports a seat at the upper end, functions as a hinge pin for the hinged seat support members. The articulated base plates and the hinged seat support members are selectively operated to permit the side frames to be moved toward each other so as to collapse the wheelchair when not in use. Each side frame includes front and rear vertically disposed tubular members which are connected by a longitudinally extending inverted U-shaped member which serves as an armrest for the occupant of the wheelchair. Each end of the armrest terminates in a downwardly extending pin which is removably received in the upper ends of the vertical posts so that the armrest is disposed at a fixed predetermined distance above the base plates. Each of the vertical posts has one or more auxiliary sockets or sleeves welded or otherwise attached thereto intermediate the ends thereof and such sleeves have an inner diameter of a size to receive the pins of the armrest. The armrest may be removed from the vertical posts and the pins inserted into the sleeves so that the armrest is disposed at a different distance above the base plates. The telescoping rod which supports the seat of the wheelchair is provided with a locking mechanism under the control of the occupant to permit the height of the seat to be adjusted at will and then locked in fixed adjusted position. This permits the occupant to assume a sitting position or to raise himself to a "standing" or eye level position when desired.

It is an object of the invention to provide an adjustable wheelchair in which an invalid or occupant may assume a sitting mode in which the armrests are disposed at a first elevation or may assume an eye level or "standing" mode with the armrests at a second elevation and in which the adjustments are made by the occupant without a mechanical lift mechanism or help from other persons.

Another object of the invention is to provide a collapsible wheelchair having a pair of generally parallel side frames connected together by a pair of articulated base plates and by a pair of hinged support members so that the side frames may be moved toward each other when the wheelchair is unoccupied.

BRIEF DESCRIPTION OF THE DRAWINGS

FIG. 1 is a front elevational view of the wheelchair of the present invention in elevated position.

FIG. 2 is a side elevational view thereof.

FIG. 3 is a top plan view.

FIG. 7 is an enlarged sectional view taken along the line 7—7 of FIG. 1.

FIG. 8 is an enlarged sectional view taken on the line 8—8 of FIG. 2.

FIG. 9 is a sectional view taken on the line 9—9 of FIG. 8.

FIG. 10 is an enlarged fragmentary detail taken on the line 10—10 of FIG. 2.

BEST MODE FOR CARRYING OUT THE INVENTION

Figure 4:
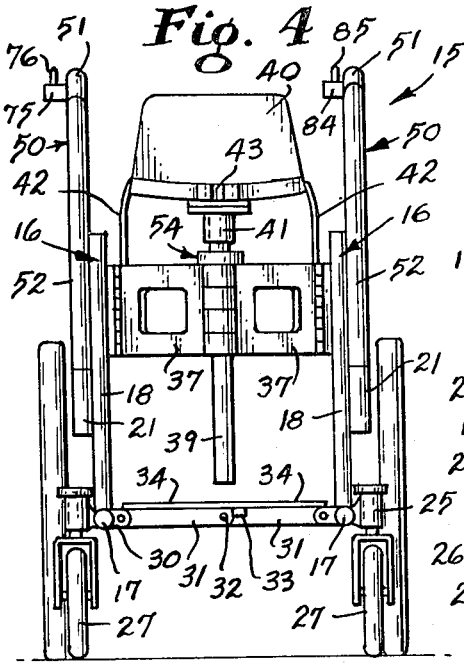
FIG. 4 is a front elevational view similar to FIG. 1 with the wheelchair in lowered position.

With continued reference to the drawings, a wheelchair 15 is provided having a pair of generally parallel upright side frames 16. Each of the side frames preferably is of hollow tubular construction and includes an elongated longitudinally extending base member 17 and a pair of generally verticaly disposed upstanding front and rear members 18 and 19, respectively. Preferably, the vertical members 18 and 19 are connected by a side plate 20 which is welded or otherwise fixed thereto to form a rigid structure. Each of the vertical members 18 and 19 has at least one relatively short sleeve or socket 21 welded or otherwise attached on the outer side thereof for a purpose which will be described later.

Each of the rear vertical members 19 is provided with an outwardly extending stub shaft 22 which rotatably receives the hub 23 of a rear ground engaging wheel 24. A vertically disposed socket 25 is welded or otherwise attached to the forward portion of each base member 17 and each of such sockets pivotally receives the pin or post 26 of a front ground engaging caster wheel 27. Although the rear wheels 24 have been illustrated substantially larger than the front caster wheels 27, it is noted that such rear wheels could be of any desired size. In addition to the front and rear wheels 27 and 24, the base member 17 normally extends rearwardly beyond the wheel 24 and is provided with a downwardly angled portion 28 on which an anti-tipping wheel 29 is mounted in a conventional manner.

In order to permit collapsing of the wheelchair when not in use, each of the base members 17 is provided with a plurality of inwardly extending lugs 30 which pivotally receive the outer ends of a pair of braces 31. The inner ends of such braces are connected together by a pivot pin 32 and one of such braces is provided with a square end which abuts a stop member 33 carried by the other brace so that such braces are axially aligned when in use and can pivot in an upward direction only. A pair of base plates 34 are welded, bolted, riveted, or otherwise attached to the braces 31 with their inner edges substantially in abutting relationship with each other and such base plates extend substantially the full length of the base members 17. Such base plates provide an articulated platform on which the occupant of the wheelchair may rest his feet. Each of the base plates 34 is provided with an opening 35 through which a person's hands may be inserted to assist in raising the base plates when the wheelchair is being collapsed.

Each of the rear vertical members 19 is provided with an inwardly extending hinge plate 36 which is welded or otherwise attached thereto. A pair of seat support plates 37 have one end hingedly connected to the hinge plate 36 by a hinge pin 38 and the other end of such seat support plates are hinged together by a seat support rod 39 which functions as a hinge pin for the plates 37. The seat support rod 39 is telescopically mounted within the hinge membes of the seat support plates 37 so as to be vertically movable when desired. A seat 40 which preferably is of molded and padded construction is provided with a socket 41 which receives the upper end of the support rod 39 and is connected thereto in such a manner that the seat may rotate about the rod but has restricted vertical movement in both directions so that the seat cannot be easily removed from the rod. Although the seat 40 may be of any desired configuration, a seat having a crotch type configuration similar to a bicycle saddle seat with an upstanding back portion is preferred so that the occupant may assume a substantially "standing" position while being supported by the seat.

Preferably, the seat is provided with one or more conventional seat belts 42 which the occupant straps onto himself for a purpose which will be described later. Also, the base plates may have openings (not shown) in alignment with the seat support rod so that such base plates may be pivoted upwardly when the seat support rod is in a lowered position in which case the lower end of the seat support rod extends through the openings in the base plates when the wheelchair is collapsed. If desired, the seat 40 may have a notch or recess 43 through which a catheter or other elongated member may extend.

As illustrated best in FIGS. 8 and 9, when the wheelchair is in operative condition, the weight of the base plates 34 tends to prevent collapsing of the wheelchair, however, in order to make certain that such collapsing does not occur accidentally, a lock bar 44 is provided which may have one end pivotally connected by a pin 45 to a pair of ears or lugs 46 welded or otherwise attached to one of the vertical members 19. The opposite end of the lock bar is removably connected to the other rear vertical member 19 in any desired manner such as by being received within a U-shaped receptacle 47 carried by such vertical member. If desired, the lock bar 44 may be connected to the U-shaped receptacle 47 by a pull pin or the like (not shown).

Figure 5:
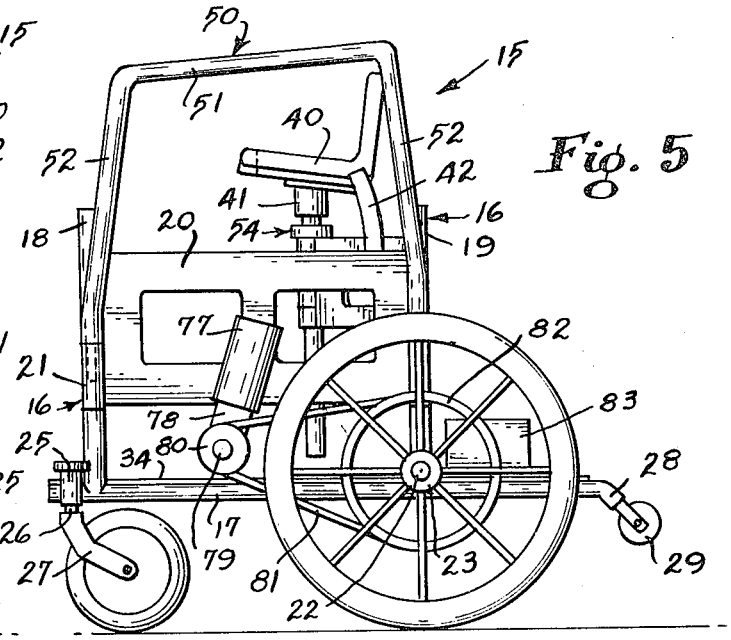
FIG. 5 is a side elevational view thereof.

A pair of inverted U-shaped armrests 50 are provided with one armrest being engagable with the side frame 16 on each side of the wheelchair. Each armrest includes a generally horizontal portion 51 integrally connected to downwardly extending portions 52. Each of the downwardly extending portions 52 terminates in an axially disposed pin 53 which is selectively received either in the upper ends of the vertical members 18 and 19 or the upper ends of the sockets 21. As illustrated best in FIGS. 1 and 2, the armrests are mounted within the vertical members 18 and 19 so that the horizontal portions 51 are located at a predetermined elevation above the base plates 34. This position is preferred when the seat 40 is in an elevated position. As shown best in FIGS. 4 and 5, the pins 53 of the armrests 50 are received within the sockets 21 so that the horizontal portions 51 are disposed at a lower elevation. This position is preferred when the seat 40 is in a lower position. If desired, the inverted U-shaped armrests 50 may have one or more braces (not shown) extending between the downwardly extending portions 52 to provide a more rigid structure. Further, in order to improve the aesthetic appearance of the wheelchair as well as to provide some measure of privacy (particularly when the occupant is wearing a catheter), a side panel (not shown) of canvas, sheet metal, or other sheet material may be applied to each armrest in any desired manner such as lacing, snaps or the like.

The seat 40 preferably is raised and lowered by the occupant of the wheelchair when the occupant places his hands on the armrests 50 on opposite sides of the wheelchair and exerts an upward force to lift his body relative to the side frames 16. The occupant normally is attached to the seat by the seatbelts 42 and therefore when the occupant's body is raised, the seat 40 and the seat support rod 39 likewise are raised. When the seat and support rod are moved relative to the seat support plates 37, it is necessary to lock the seat support rod 39 in its adjusted position. In order to do this, a lock mechanism 54 is fixed to one of the seat support plates 37 and such lock mechanism is controlled by the occupant of the wheelchair.

Figure 11:
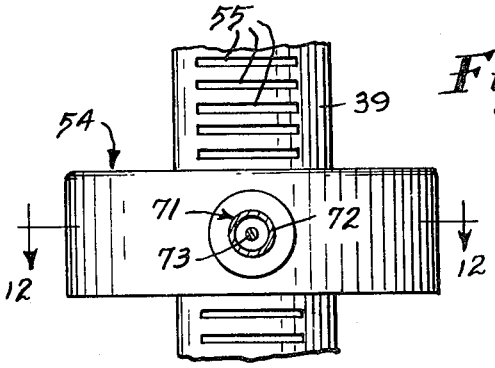
FIG. 11 is an enlarged detail view taken on the line 11—11 of FIG. 2.
Figure 12:
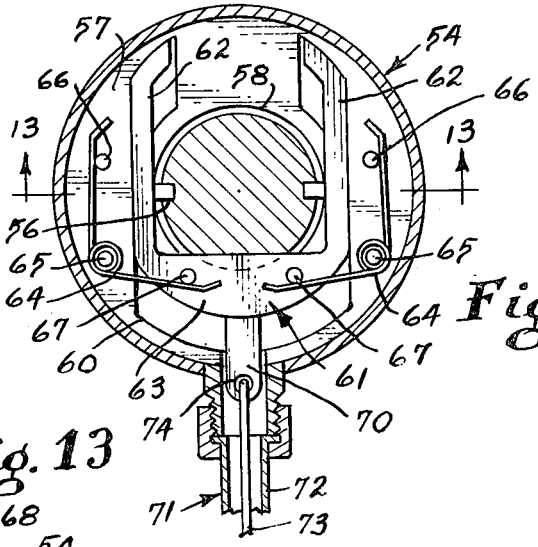
FIG. 12 is a sectional view taken on the line 12—12 of FIG. 11.
Figure 13:
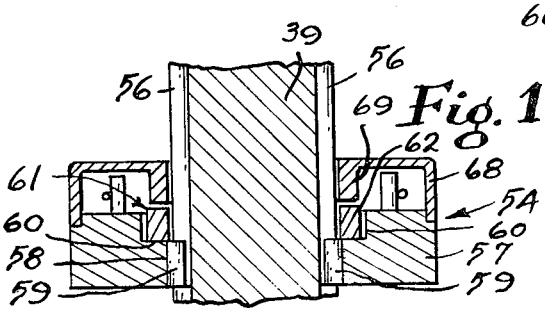
FIG. 13 is a sectional view taken on the line 13—13 of FIG. 12.

With particular reference to FIGS. 11, 12 and 13, the seat support rod 39 is provided with a series of closely spaced substantially parallel notches 55 which extend generally normal to the axis of such rod. Additionally, the seat support rod includes a pair of elongated grooves 56 located on opposite sides of the rod and extending substantially the full length thereof. The lock mechanism 54 includes a lock collar 57 which is fixed to one of the side support plates 37 and is provided with an axial opening 58 through which the seat support rod 39 is freely movable. A pair of keys 59 extend inwardly from opposite sides of the opening 58 and such keys are received within the grooves 56 to prevent rotation of the seat support rod relative to the lock collar. The lock collar has a shouldered recess or slideway 60 in its upper portion and such recess slidably receives a generally U-shaped lock plate 61. The arms 62 of the lock plate are disposed on opposite sides of the seat support rod and are connected by a bight portion or web 63 of a thickness to be received within the notches 55 in the support rod 39.

In order to urge the lock plate 61 into intimate engagement with the notches in the support rod, a pair of coil springs 64 are mounted about posts 65 carried by the lock collar 57 on opposite sides of the recess 60. One end of each coil spring abuts a post 66 carried by the lock collar in spaced relationship to the post 65 and the opposite end of each of the coil springs engages a post 67 carried by the lock plate 61. Pretensioning of the spring causes the ends of the spring to apply a spring pressure on the lock plate in a direction to urge the bight portion of the lock plate toward the rod 39. A housing 68 is mounted on the lock collar 57 to protect the working mechanism of the lock and such housing has a sleeve 69 extending downwardly from the upper wall and such sleeve is of a size to permit the support rod 39 to pass freely therethrough while limiting upward movement of the lock plate 61.

In order to retract the lock plate from locking position within the notches 55, a tonque 70 is connected to the bight portion or web 63 of the lock plate and extends in a direction away from the support rod 39. A flexible cable 71 is provided which includes a flexible housing 72 with a continuous wire 73 projecting outwardly from opposite ends. One end of the flexible housing 72 is connected to the lock mechanism 54 and one end of the wire 73 is attached to the tongue 70 in any desired manner, as by passing through an opening 74 adjacent the end of the tongue. The opposite end of the flexible cable terminates at a control box 75 mounted on the horizontal portion 51 of one of the armrests and such control box includes a control lever 76 to which the other end of the wire 73 is attached in any desired manner (not shown). The control box 75 is located in a position readily accessible to one of the hands of the occupant of the wheelchair so that the occupant may use one finger to shift the lever 76 and thereby retract the lock plate 61 from the notch 55 against the tension of the spring 64.

When the lock plate is retracted, the seat support rod 39 may be raised or lowered by the occupant raising or lowering his body. When the occupant's body is in a desired position, the occupant releases the lever 76 so that the coil springs 64 urge the lock plate into intimate engagement with the rod. If the lock plate is not in alignment with one of the notches 55, a slight vertical movement in either direction of the seat support rod will align a notch with the lock plate, at which time the coil springs 64 urge the bight portion of the lock plate into the notch to prevent further vertical movement.

The wheelchair 15 may be propelled manually by a hand ring (not shown) mounted on the rear wheels 24, if desired. However, as illustrated, a variable speed, reversible electric motor or other power plant 77 is mounted on each of the side frames 16 and such electric motor is connected to a gear box 78 having an output shaft 79 on which a drive pulley 80 is mounted. The drive pulley engages a drive belt 81 which extends around a driven pulley 82 fixed to the rear wheel. The electric motor is supplied with energy from a battery 83 mounted on the base plates 34 and such electric motor is connected by electrical conduits (not shown) to a control box 84 having a control lever 85. The control box 84 normally is positioned on the horizontal portion 51 of the armrest opposite the lock mechanism control box. It is contemplated that the control boxes 75 and 84 may be placed on either of the armrests, depending upon the preference of the operator, or if desired, both of the control boxes could be mounted on the same armrest.

Figure 6:
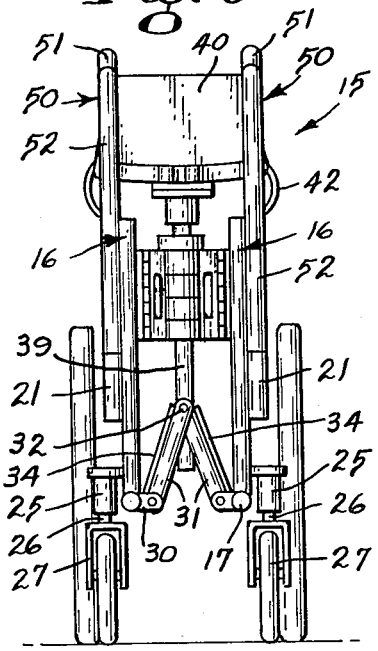
FIG. 6 is a front elevational view illustrating the wheelchair in collapsed condition.

In the operation of the device, assume that the wheelchair 15 is in collapsed condition as illustrated in FIG. 6. When it is desired to use the wheelchair, a downward force is applied to the apex of the base plates 34 and braces 31 to cause the side frames to spread apart until the braces are substantially in axial alignment and are stopped from swinging any further. The lock bar 44 is swung downwardly from its substantially vertical stored position until the free end of the lock bar is located within the receptacle 47. In this position, a person moves onto the seat or is moved onto the seat and the seat belts 42 are secured around such person. If the position of the seat 40 and the armrests 50 are satisfactory, the occupant may operate the lever 85 of the control box 84 to control operation of the electric motors 77 and drive the wheelchair to any desired location.

If the occupant wishes to change the elevation of the seat, he places his hands on both armrests and applies a downward force thereto, which in turn aplies a lifting force on his body to support his weight. At this time, the occupant operates the lever 76 of the control box 75 to release the lock plate 61 from the notch 55 after which the occupant may raise or lower his body as desired. Since the seat belts 42 connect the occupant's body to the seat 40, the seat support rod 39 is moved vertically relative to the seat support plates 37. When the occupant's body is in a desired position, the lever 76 is released and the springs 64 move the lock plate 61 into one of the notches 55.

After the seat has been adjusted, the occupant may wish to adjust the height of the armrests 50. If the armrests are too high, an upward force is applied to the horizontal portions 51 so that the pins 53 slide out of the vertical side members 18 and 19 and thereafter such pins are inserted into the sleeves or sockets 21. Conversely, if the armrests are too low, the occupant retracts the pins of the armrests from the sleeves 21 and inserts such pins into the upper ends of the vertical side members 18 and 19.

Since the center of gravity of the wheelchair is relatively low because of the location of the motors, batteries and the weight of the operator being transferred to the side frames and hence to the base tubular members and ground engaging wheels, the operator may safely move the wheelchair from place to place while the seat is in a raised position and the operator is in a "standing" mode. This permits the operator to assume a "standing" position (preferably with his knees slightly bent for good circulation) while working in a kitchen or the like or while shopping. However, if the operator becomes tired of standing, he is capable of lowering himself to a "sitting" position or to an intermediate position without assistance.

In addition to the psychological advantage of the sitting and standing positions, a distinct medical advantage is achieved since the "standing" position tends to slow bone deterioration and improves the functions of the gastro-intestinal tract. Further, the raising and lowering of the body by the use of the arms and upper torso improves the muscle tone and blood circulation of the person in the wheelchair and the exercise promotes the general well being and attitude of the person.

I claim:

1. An adjustable wheelchair comprising a frame supported by ground engaging wheels, rod means vertically slidably carried by said frame, a seat mounted on said rod means, means for releasably securing the occupant of said wheelchair to said seat, locking means for securing said rod means in fixed adjusted position relative to said frame, control means spaced from said locking means, means for operatively connecting said control means to said locking means, said control means being selectively operated to release said locking means from secure engagement with said rod means, and armrest means carried by said frame, said means for releasably securing the occupant to said seat being operatively connected to raise said seat when an upwardly directed force is applied thereto by the occupant and said locking means is released, whereby the occupant of the wheelchair selectively adjusts the vertical position of said seat by releasing said locking means after which the occupant moves his body and said seat to a selected position.

2. The wheelchair of claim 1 in which said frame includes a pair of side members, a pair of seat support plates hingedly mounted at one end to said side members, the other end of said seat support plates being hingedly connected to each other by said rod means so that the wheelchair is collapsible.

3. The wheelchair of claim 1 in which said frame includes at least first and second pairs of armrest mounting means, said first pair of armrest mounting means being located at a first elevation on said frame, said second pair of armrest mounting means being located at a second elevation on said frame, said first elevation being vertically spaced from said second elevation, said armrest means being selectively removably attached to either of said first and second armrest mounting means so that said armrest means are vertically adjustably mounted relative to said frame.

4. The wheelchair of claim 3 in which each of said first and second pairs of armrest mounting means includes socket means, and said armrest means includes pin means of a size to be received within said socket means.

5. The wheelchair of claim 1 in which a plurality of vertically spaced notches are provided on said rod means, said locking means including a locking plate which is selectively engagable with one of said notches, said control means being mounted to said armrest means, so as to be operated by the occupant, and said means for operatively connecting said control means to said locking means including means for extending and retracting said locking plate into and out of engagement with a selected notch.

6. An adjustable wheelchair comprising a frame supported by ground engaging wheels, said frame having a pair of side members, a pair of seat support plates hingedly mounted at one end to said side members, the other end of said seat support plates being hingedly connected to each other by a rod means so that the wheelchair is collapsible, said rod means being vertically slidable with respect to said frame, a seat mounted on said rod means, means for releasably securing the occupant of said wheelchair to said seat, means for releasably locking said rod means in fixed adjusted position relative to said frame, and armrest means carried by said frame, whereby the occupant of the wheelchair selectively adjusts the vertical position of said seat by placing his hands on said armrest means and releasing said locking means after which the occupant moves his body and said seat to a selected position.

7. An adjustable collapsible wheelchair comprising a pair of generally parallel side frames supported by ground engaging wheels, each of said side frames including a first pair of armrest connecting means located at a first elevation, each of said side frames having at least one second pair of armrest connecting means attached thereto at a second elevation, an armrest carried by each of said side frames, each of said armrests having means selectively engaging either of said first and second pairs of armrest connecting means, a pair of seat support plates hingedly mounted at one end to said side frames, rod means hingedly connecting the other end of said seat support plates together, a seat carried by said rod means, seat belt means for connecting the occupant of said wheelchair to said seat, said rod means being slidably carried by said seat support plates, a lock mechanism carried by said seat support plates and engagable with said rod means to lock said rod means in fixed adjusted position, and said lock mechanism being selectively controlled by the occupant, whereby the occupant of the wheelchair selectively adjusts the vertical position of said seat by supporting his weight on said armrests and releases said lock mechanism after which the occupant moves his body and said seat to a selected position.

8. The wheelchair of claim 7 including a power plant for propelling said wheelchair, control means for controlling the operation of said power plant, and said control means being mounted on one of said armrests in a position readily accessible to the occupant of said wheelchair.

9. The wheelchair of claim 7 including an articulated base connecting said side frames.

10. A wheelchair adjustable to various vertical heights by the occupant comprising a frame supported by ground engaging wheels, rod means vertically slidably carried by said frame, a seat mounted on said rod means so as to be vertically adjustable between an upper and lower position with respect to said frame, said upper position being of a height to permit said seat to support the occupant in a substantial standing position and said lower position being of a height to permit said seat to support the occupant in a seated position, means for releasably securing the occupant of said wheelchair to said seat, locking means for securing said rod means in fixed adjusted position relative to said frame, and armrest means carried by said frame, and control means mounted remote from said locking means and operable by the occupant while seated in the wheelchair for selectively releasing said locking means, whereby said seat is vertically adjusted as the occupant of the wheelchair selectively adjusts the vertical position of said seat by releasing said locking means after which the occupant moves his body and said seat to a selected position.

11. The wheelchair of claim 10 in which said frame includes at least first and second pairs of armrest mounting means, said first pair of armrest mounting means being located at a first elevation on said frame, said second pair of armrest mounting means being located at a second elevation on said frame, said armrest means being selectively removably attached to either of said first and second armrest connecting means so that said armrest means are vertical adjustably mounted relative to said frame.

* * * * *